United States Patent [19]

Nagai

[11] 4,243,910

[45] Jan. 6, 1981

[54] FILAMENT SUPPORT ASSEMBLY FOR DISPLAY DEVICE

[75] Inventor: Kiyoshi Nagai, Urawa, Japan

[73] Assignee: Wakoh Corporation, Tokyo, Japan

[21] Appl. No.: 936,770

[22] Filed: Aug. 25, 1978

[51] Int. Cl.[3] ..... H01K 1/18; H01K 7/04

[52] U.S. Cl. ..... 313/522

[58] Field of Search ..... 313/522

[56] References Cited

U.S. PATENT DOCUMENTS

| | | | |
|---|---|---|---|
| 3,408,523 | 10/1968 | Demarest et al. | 313/522 |
| 3,604,971 | 9/1971 | Tracy | 313/522 |
| 3,743,880 | 7/1973 | Demarest | 313/522 |

*Primary Examiner*—Palmer C. Demeo

*Attorney, Agent, or Firm*—Watson, Cole, Grindle & Watson

[57] ABSTRACT

In a display lamp wherein at least three parallel filaments for horizontal lines and at least four filaments for vertical lines coupling the ends of the horizontal-line filaments are arrayed in the shape of a character "' '" and are switched on or off selectively to indicate a digit, mark, letter or symbol, twelve electrode plates are welded individually to twelve leadwires constituting a stem of a display unit. The electrode plates are so prearranged that the ends of the horizontal-line filaments and the ends of the vertical-line filaments connected between the electrode plates are superposed exactly on each other in a nomral to the fireplate or the display lamp direction with the horizontal and vertical filaments being respectively displaced at different levels to be in non-contacting relationship.

8 Claims, 9 Drawing Figures

FILAMENT SUPPORT ASSEMBLY FOR DISPLAY DEVICE

BACKGROUND OF THE INVENTION

The present invention relates to a display lamp capable of performing digital display of a numerical value as well as a mark, letter or symbol, and more particularly to an improvement suited for use in a display panel for aircraft due to its excellent brightness and distinction in the digit, mark, letter or symbol displayed.

For the reason that a display unit S of such a lamp is required to be able to display any of digits from 0 to 9, it is constituted by a total of several display elements which consist of at least three parallel horizontal elements and at least four vertical elements coupling the ends of the horizontal elements in a manner to shape a character "8" and are switched on or off selectively to display a desired digit. In general, each display element can be composed of a liquid crystal, light emitting diode or filament. In a display panel for aircraft, however, a filament is employed to meet the requisites of high display brightness and distinction.

In a display unit S using filaments, it is necessary to attain clear display in the corner connections where the seven display elements intersect one another and, in case satisfactory clearness is not attained, the digit or mark, letter or symbol displayed becomes indistinct to render reading difficult.

For the purpose of ensuring the required clearness, there is proposed an exemplary device as illustrated in FIG. 1 where vertical and horizontal display elements are so disposed as to intersect each other at the corners. However, if the display elements employed are filaments, electrical conduction occurs among them as a result of mutual intersection and contact of the filaments, thereby making it impossible to switch on the desired filaments alone selectively. And thus, it becomes necessary to prevent mutual contact between the horizontal and vertical filaments at the corners by spatially separating them from one another for isolation.

In a known display lamp shown in FIG. 1, filaments A, G and D for horizontal lines and filaments B, C, E and F for vertical lines are arrayed on different spatial planes to be kept out of mutual contact. And the ends of the individual filaments are positioned on electrodes 1 through 12 respectively, of which 2, 3, 4, 5 and 9 serve as common electrodes enabling mutual conduction. Supposing that the electrodes 2, 4, 5, 8 and 11 hold the high-level horizontal filaments A, G and D, then the remaining electrodes 1, 3, 6, 7, 9 and 12 are to hold the low-level vertical filaments B, C, E and F. It is necessary, therefore, that internal leadwires 22, 24, 25, 28 and 31 are slightly longer than internal leadwires 21, 23, 26, 27, 29 and 32, and the electrodes 2, 4, 5, 8 and 11 are positioned on a high-level plane in the display unit S while the other electrodes 1, 3, 6, 7, 9 and 12 are positioned on a low-level plane. It is also necessary to maintain filaments B, C, E and F out of contact with internal leadwires 21, 23, 26, 27 and 29. The position of the filaments is determined according to the sealing position of the leadwires and the display quality of the display lamp is affected thereby. It is therefore necessary that the position of the leadwires in the stem or the display unit be precisely determined.

In addition to the above, eight leadwires 41 through 48 are required for external lead terminals. In the prior art, two groups of such external leadwires, each consisting of four leadwires, protrude in parallel with one another as illustrated in FIG. 2 to form terminals b, a, g, c and f, h, d, c, with the terminal h serving as the aforementioned common electrode.

In a socket 16 shown in FIG. 3, the internal leadwires 21 through 32 and the external leadwires 41 through 48 are connected as follows: external leadwire 46 having common terminal h is connected to internal leadwires 22, 23, 24, 25 and 29 having electrodes 2, 3, 4, 5 and 9; external leadwire 42 having terminal a is connected to internal leadwire 31 having electrode 11; external leadwire 41 having terminal b is connected to internal leadwire 21 having electrode 1; external leadwire 44 having terminal c is connected to internal leadwire 26 having electrode 6; external leadwire 47 having terminal d is connected to internal leadwire 28 having electrode 8; external leadwire 48 having terminal e is connected to internal leadwire 27 having electrode 7; external leadwire 45 having terminal f is connected to internal leadwire 32 having electrode 12; and external leadwire 43 having terminal g is connected to internal leadwire 30 having electrode 10.

In the display unit S, hermetic sealing glass is poured onto the bottom of its metallic side wall drawn downward slightly, and the internal leadwires 21 through 32 are sealed therein with the glass to constitute a stem. The filaments are set directly on leadwires 21–32, adjacent to each other with the spaces between the leadwires being narrow. However, despite the narrow spaces it is necessary for the internal leadwires to be spaced in the glass without disturbing their positioning. In the socket 16, the external leadwires 41 through 48 are fixed firmly, and a face glass member is provided hermetically on the top of the metallic side wall.

Therefore, in manufacture of a conventional display lamp, first a high-precision stem is composed of upper-level and lower-level internal leadwires 21 through 32 for setting the filaments A through G individually, and then the stem thus obtained is connected to the external leadwires 41 through 48 in the socket. Consequently, there exist some disadvantages including that a large number of components are required and the number of manufacturing processes becomes extremely great to bring about an increase of production cost.

OBJECTS OF THE INVENTION

In an attempt to eliminate the disadvantages observed in the prior art, an object of the present invention is to provide an improved display lamp which is capable of effecting clear and distinct display of a digit, mark, letter or symbol through selective switching on and off of filaments, while minimizing the number of manufacturing processes required and reducing the production cost.

It is another object of the invention to provide an improved display lamp in which at least twelve internal leadwires are decreased to eight while at least eight external leadwires are left unchanged.

And it is a further object of the invention to provide an improvement of a simplified structure wherein a stem is constituted by leadwires and a single glass block having an H-shaped cross section.

Other objects of the invention will become apparent from the following detailed description taken in conjunction with the accompanying Figures.

SUMMARY OF THE INVENTION

For the purpose of achieving the above objects, the display lamp of the present invention is so constructed that metallic electrode plates, which are pre-arranged for setting filaments on at least two different-level planes, are welded to the ends of leadwires sealed in a display unit, and the filaments for horizontal lines and the filaments for vertical lines are connected with one another on the metallic electrode plates in a manner such that the levels of the horizontal and vertical filaments are spaced apart from each other and the respective corners are mutually connected ar viewed from the front of the display lamp.

Due to such a structure the socket can be constituted of leadwires by drawing out the leadwires directly from the display unit and connecting the common electrodes with one another outside of the display unit.

Additionally, it is not necessary to precisely seal the internal electrodes to maintain the position of the filaments.

DESCRIPTION OF THE PREFERRED EMBODIMENTS

Figure 1:
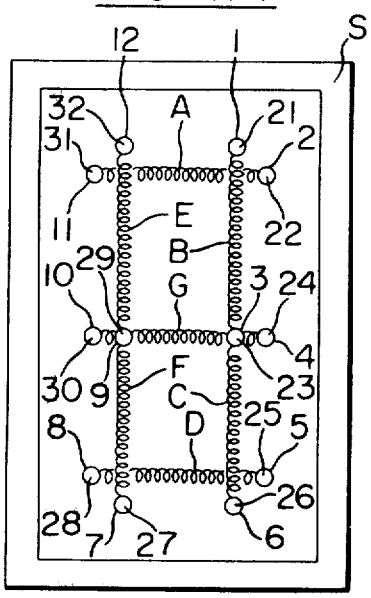
FIG. 1 PRIOR ART
FIG. 1 is a front view of a display unit S in an exemplary display lamp according to the prior art.
Figure 2:
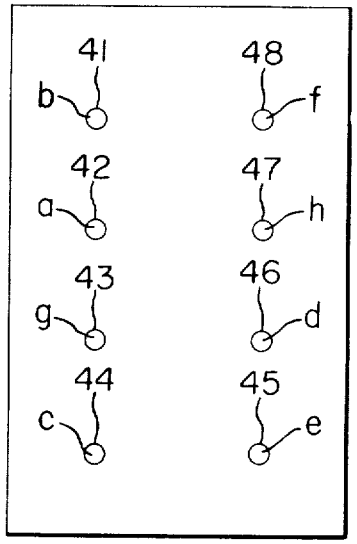
FIG. 2 PRIOR ART
FIG. 2 is a rear view of a socket in the display lamp of FIG. 1.
Figure 3:
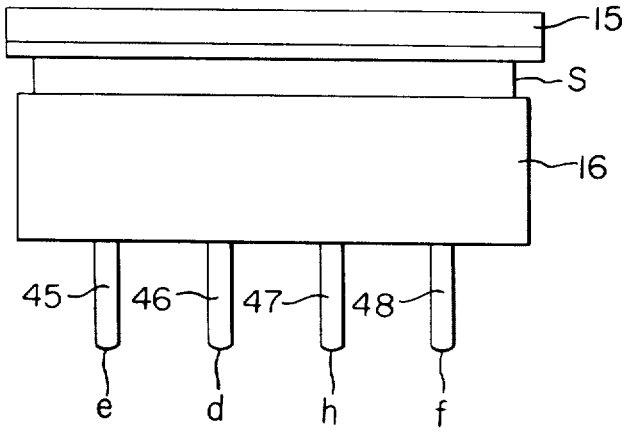
FIG. 3 PRIOR ART
FIG. 3 is an exterior side view of the display lamp of FIG. 1.
Figure 4:
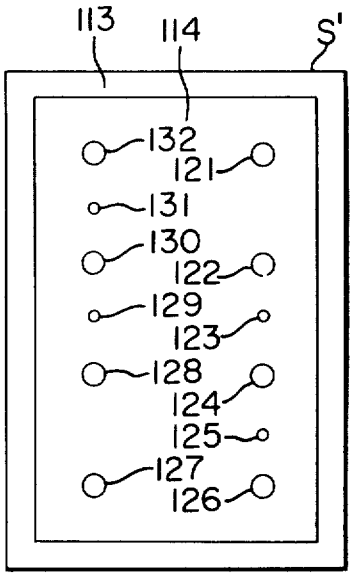
FIG. 4 shows the ends of leadwires in a display unit of a lamp embodying the present invention.
Figure 5:
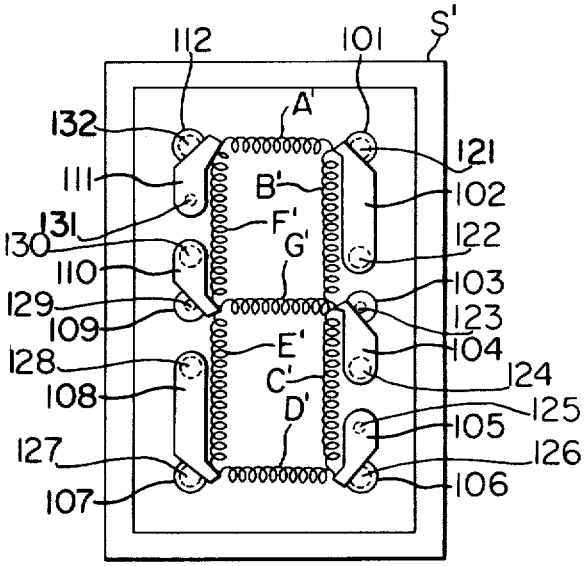
FIG. 5 is a front view illustrating a state where electrode plates and filaments are disposed at the leadwire ends of FIG. 4.
Figure 9:
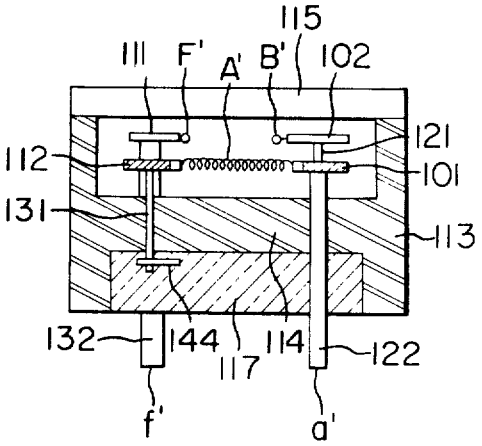
FIG. 9 is a cross-sectional side view of FIG. 8.

In FIG. 4, an outer wall surrounding a display unit S' is composed of a glass block 113 having an H-shaped cross section as shown in FIG. 9. Out of twelve leadwires piercing through an intermediate bottom 114 and enclosed hermetically as shown in FIG. 9, eight leadwires 121, 122, 124, 126, 127, 128, 130 and 132 are thicker in diameter than the other leadwires 123, 125, 129 and 131 connected to the leadwires 130 of a common electrode, and a stem is constituted of these leadwires 121 through 132. In the display unit S', the inner ends of the leadwires are separately positioned on a high level and a low level as in the known art. And as shown in FIG. 5, metallic electrode plates 101 through 112 pre-molded in a proper design to position the filaments are welded to the ends of the corresponding leadwires individually in such a manner that electrode plate 101 is welded to the end of leadwire 121, electrode plate 102 to the end of leadwire 122 and so forth. A horizontal-line filament A' is connected to the electrode plates 102 and 111, and similarly a filament G' to the electrode plates 104 and 110, and a filament D' to the electrode plates 105 and 108, respectively. A vertical-line filament B' is connected to the electrode plates 101 and 103, and similarly a filament C' to the electrode plates 103 and 106, a filament E' to the electrode plates 107 and 109, and a filament F' to the electrode plates 109 and 112, respectively.

As viewed from front of the display unit S', the horizontal-line filaments A', D', G' and the vertical-line filaments B', C', E', F' may seem to be in contact with each other. However, if the filaments are actually in mutual contact, electrical conduction will occur to render impossible the selective switching on and off of the filaments A' through G' for a desired display. Therefore, it is necessary that both the horizontal-line filaments A', D', G' and the vertical-line filaments B', C', E', F' are on different levels spatially. And such a structure can be obtained by connecting the filaments to the pre-arranged electrode plates 101–112 individually in the aforementioned manner. Because of the pre-arranged electrode plates, precise regulation is not needed with respect to the positions where the leadwires are to be sealed.

Figure 6:
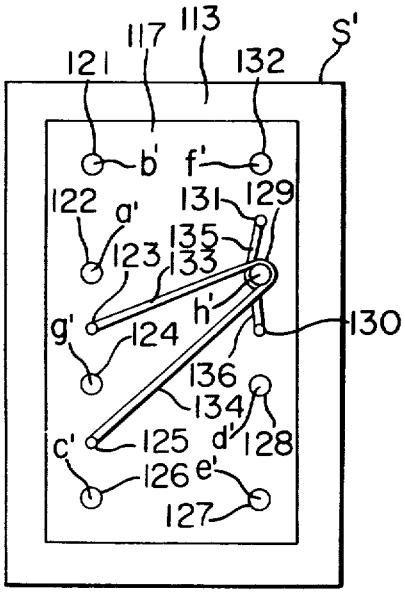
FIG. 6 is a rear view showing the back of FIG. 5.
Figure 8:
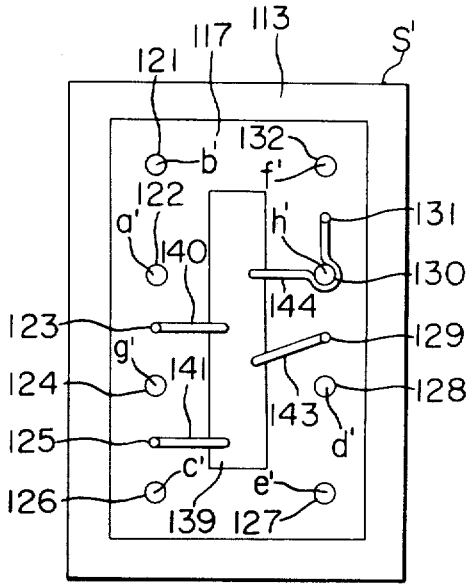
FIG. 8 is a rear view of a further embodiment.

For the purpose of using the leadwires directly in the socket except those to be connected to the common electrode, the leadwires 121, 122, 124, 126, 127, 128, 130 and 132 are arrayed in two rows substantially at equal intervals as illustrated in FIGS. 6 and 8, and the respective outer ends serve as terminals b', a', g', c', e', d', h' and f'. And a thin leadwire 123 interposed between leadwires 122 and 124, a thin leadwire 125 between leadwires 124 and 126, a thin leadwire 129 between leadwires 128 and 130, and a thin leadwire 131 between leadwires 130 and 132 are connected to the common electrode h'.

Figure 7:
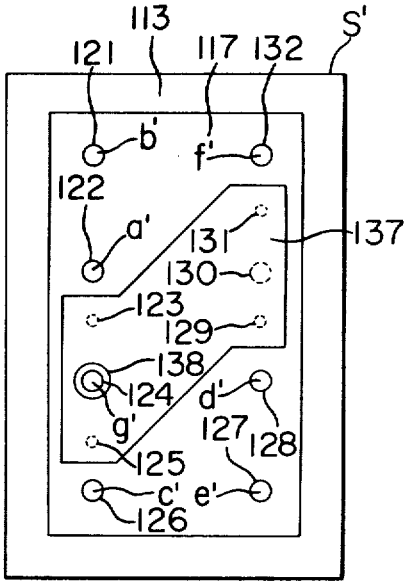
FIG. 7 is a rear view of another embodiment of the invention.

The above process is performed, as shown in FIG. 6, by connecting the thin leadwires 123, 125, 129 and 131 through conductors 133, 134, 135 and 136 to the leadwire 130 having the common electrode h'. And it may also be excuted, as shown in FIG. 7, by connecting the thin leadwires to the leadwire 124 through a conductive plate 137 insulated by means of a hole 138 or, as shown in FIG. 8, by connecting the thin leadwires to the leadwire 130 through conductors 140, 141, 142, 143 and a conductive plate 139 isolated from each leadwire. The connections are located below the center bottom 114 of the H-shaped glass block 113 shown in FIG. 9, and this region is filled with a resin 117 to constitute the socket. The filaments are stretched on the electrode plates above the leadwires in the display unit S', which is hermetically sealed at the top thereof with a face glass member 115. And a desired display lamp is obtained by evacuating the display unit S'.

Furthermore, in the display lamp having seven filaments in all; that is, three parallel filaments for horizontal lines and four filaments for vertical lines, there can additionally be provided one or several more filaments and twice as many leadwires as the filaments above for supplying electric current thereto in order to indicate a decimal point, etc.

According to the present invention, as described hereinabove, an improved display lamp is achievable at a low production cost with the least number of components and minimal manufacturing processes.

While the described embodiment represents a preferred form of the present invention, it is to be understood that modifications will occur to those skilled in the art without departing from the spirit of the invention. The scope of the invention is therefore to be determined solely by the appended claims.

What is claimed is:

1. A filament support assembly for a filament type display device, comprising:

a plurality of first leadwires extending through the bottom of the display device;

a plurality of second leadwires extending through said bottom a greater distance than said plurality of first leadwires;

a plurality of first electrode plates each connected to a respective one of said plurality of first leadwires;

a plurality of second electrode plates each connected to a respective one of said plurality of second leadwires;

a plurality of first filaments extending in a first direction and each said first filament including end portions connected between respective ones of either said first or second electrode plates in substantially a first plane;

a plurality of second filaments extending in a second direction and each said second filament including end portions connected between respective ones of the other of said first or second electrode plates in substantially another plane parallelly spaced from said first plane; and the points of interconnection of respective ones of said first filaments with said first or said second electrode plates and the points of interconnection of respective ones of said second filaments with the other of said first or second electrode plates being in substantially superposed relationship in a direction substantially transverse to said first and second planes.

2. A filament support assembly as defined in claim 1, further comprising a glass block having an H-shaped cross section, and said plurality of first and second leadwires are sealed in the center bottom of said glass block in a recess formed by two parallel arms of said H-shaped cross section.

3. A filament support assembly as in claim 1, further comprising electrically conductive means interconnecting selected ones of said first or second leadwires.

4. A filament support assembly as in claim 1 wherein said electrically conductive means includes a plurality of electrical conductors extending from one of said commonly connected first or second leadwires to the remaining ones of said selected ones of said first or second leadwires.

5. A filament support assembly as in claim 3 wherein said electrically conductive means comprises an electrically conductive substantially planar plate interconnecting said selected ones of said first or second leadwires.

6. A filament support assembly as in claim 3 wherein said electrically conductive means includes an electrically conductive substantially planar plate and a plurality of electrical conductors extending from said selected ones of said first or second leadwires to said electrically conductive plate.

7. A filament support assembly as in claim 2 further comprising an insulating resinous material filling said recess.

8. A filament support assembly as in claim 7 further comprising a glass plate mounted on the other two of the parallelly extending arms of said H-shaped cross section for enabling observation of said plurality of said first and second filaments.

* * * * *